United States Patent [19]

Leonard et al.

[11] 4,171,001

[45] Oct. 16, 1979

[54] METHOD FOR MAKING A WEFT AND A WIG MADE FROM THE SAME

[75] Inventors: Richard L. Leonard, Decatur, Ala.; Allan D. Chernack, Marlboro, N.J.

[73] Assignee: Monsanto Company, Decatur, Ala.

[21] Appl. No.: 853,052

[22] Filed: Nov. 21, 1977

[51] Int. Cl.[2] ..... A41G 3/00

[52] U.S. Cl. ..... 132/53

[58] Field of Search ..... 132/53, 54, 5, 93, 89

[56] References Cited

U.S. PATENT DOCUMENTS

| | | | |
|---|---|---|---|
| 3,674,631 | 7/1972 | Schwarz | 132/53 |
| 3,837,351 | 9/1974 | Thornton | 132/89 |
| 3,850,179 | 11/1974 | Takeya et al. | 132/5 |

FOREIGN PATENT DOCUMENTS

| | | | |
|---|---|---|---|
| 3674631 | 12/1971 | United Kingdom | 132/5 |

*Primary Examiner*—G. E. McNeill

*Attorney, Agent, or Firm*—Robert L. Broad, Jr.

[57] ABSTRACT

A wig and a method of making a weft for use in making the wig wherein 5 to 50 weight percent of a first modacrylic fiber having a denier of 30 to 50 and a shrinkage of 5 to 20 percent at a temperature of 120° C. is blended with 95 to 50 weight percent of the second modacrylic fiber having a denier of 30 to 50 and a shrinkage of at least five percent less than the shrinkage of the first fiber at a temperature of 120° C. The blended fibers are assembled and sewed to form a weft and the weft is then heated to a temperature of 110° to 130° C. for a time period of 1 to 5 minutes to shrink the fibers. This produces an interaction of high shrinking and low shrinking fibers, thus imparting unique properties of cover, manageability and naturalness to the weft.

9 Claims, 2 Drawing Figures

METHOD FOR MAKING A WEFT AND A WIG MADE FROM THE SAME

BACKGROUND OF THE INVENTION a. Field of the Invention

This invention relates to wig wefts and wigs made from the same.

b. Description of the Prior Art

In the conventional wig making process, substantially straight, parallel filaments are assembled into a thin layer which is then sewed across one end to form a weft. The layer of filaments making up the weft is then wound onto a mandrel which is then placed in an oven to heat treat the filaments and thereby set them in a curled configuration. The weft is then sewed to a cap to form a wig. Straight, uncrimped filaments are generally used in making the weft to avoid the mechanical difficulties which would be involved in making the weft from crimped filaments.

In the past, when it has been desired to simulate the texture of Negroid hair where the filaments have a kinky configuration, it has been necessary to impart to the fibers, in the manufacturing stage, a high degree of crimp. The disadvantage of this process is that crimped filaments often take on an artificial, mechanically crimped appearance, are costly to produce, and are difficult to assemble and form into a weft.

In the prior art wigs of the ethnic type, where a crimp is imparted to the fibers, this crimp has been uniform along the lengths of the fibers making up the wefts.

SUMMARY OF THE INVENTION

A wig and the method of making a weft for use in making the wig wherein 5 to 50 weight percent of a first modacrylic fiber having a denier of 30 to 50 and a shrinkage of 5 to 20 percent at a temperature of 120° C. is blended with 95 to 50 weight percent of the second modacrylic fiber having a denier of 30 to 50 and a shrinkage of at least five percent less than the shrinkage of the first fiber at a temperature of 120° C. The blended fibers are assembled and sewed to form a weft and the weft is then heated to a temperature of 110° to 130° C. for a time period of 1 to 5 minutes to shrink the fibers. The treated weft is then sewed to a cap to form a wig.

DETAILED DESCRIPTION OF THE INVENTION

Figure 1:
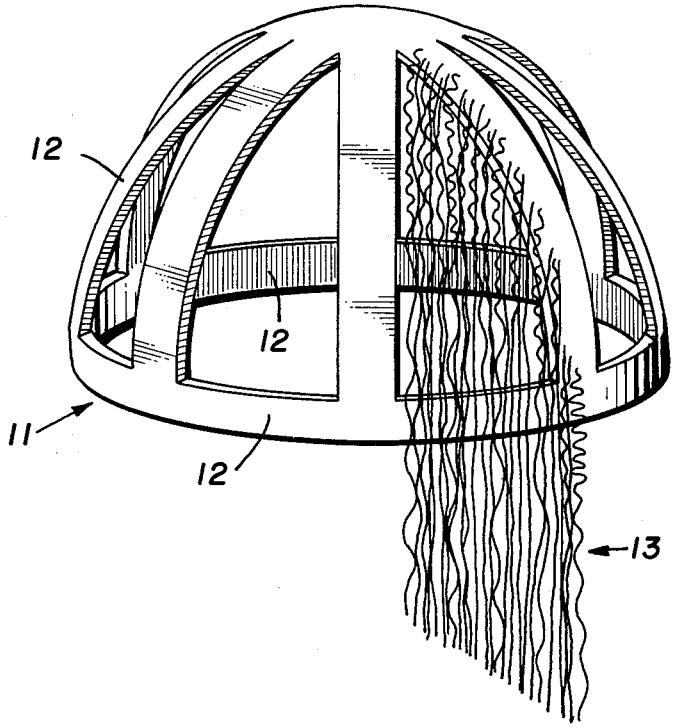
FIG. 1 is prespective view of a wig cap to which the weft of the present invention has been sewn.

Referring now in detail to the drawing there is shown in FIG. 1 a cap 11 made from fabric bands 12 in a conventional manner. Secured to the cap 11 is a weft 13 made of modacrylic fibers 16 sewed to a weft band 17 in the manner illustrated in FIG. 2. For purposes of illustration, only one weft is shown in FIG. 1. It should be understood that a sufficient number of wefts 13 will be secured to the cap 11 to fully cover the cap and form the wig.

Figure 2:
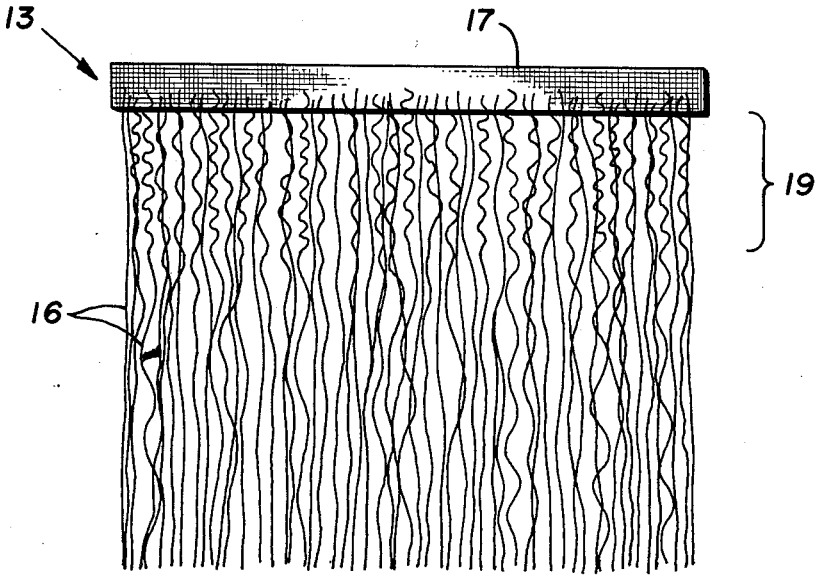
FIG. 2 is a plain view showing the configurations of the fibers in the weft after the weft has been heat treated.

The fibers forming the weft 13 are a blend of modacrylic fibers made up of (1) 5–50 weight percent of a first modacrylic fiber having a denier of 30 to 50 and a shrinkage of 5 to 20 percent at a temperature of 120° C.

with (2) 95–50 weight percent of a second modacrylic fiber having a denier of 30 to 50 and a shrinkage of at least five percent less than the shrinkage of the first fiber at a temperature of 120° C. The fibers 16 are cut into an appropriate length and arranged in a parallel relationship in unshrunken form and are then sewed to the weft band 17 as illustrated in FIG. 2. Inasmuch as the fibers 16 are in a straight, uncrimped condition, there will be little difficulty in manually assembling the fibers in a thin layer and sewing this layer to the weft band 17. While the weft 13 may be several inches in width, it is only a few filaments thick. It will be noted from FIG. 2 that the band 17 is sewed across one end of each fiber 16, thereby leaving the fibers free at the other end of the weft.

It has been known that a mixture of fibers having differential shrinkage characteristics can be used to form a bulky yarn. In this situation, the fiber blend is formed into a relatively thick bundle of closely associated fibers prior to heat treatment. The close proximity of the various fibers in the bundle will cause the fibers having the lower shrinkage characteristic to bend and curl to give the yarn a bulky configuration. It was unexpected to discover that a like result can be obtained in a weft where the layer of fibers is only a few fibers thick and the fibers are not closely associated. Until this invention, it was thought that, in such a weft, the higher shrinkage fibers would shrink and, in shrinking, remain relatively straight, while there would be little or no bulking of the fibers having the lower shrinkage characteristics. It has been found that the greater shrinkage of the higher shrinking fibers of the blend will cause the fibers having the lower shrinkage characteristics to bend and curl, even in a weft only a few fibers thick.

After the fibers 16 have been sewn to the weft band 17, the weft is wound onto a mandrel (not shown) which may be in the form of a metal tube. The mandrel is placed in contact with the free ends of the fibers 16 and the weft is wound around the mandrel in such a manner that the free ends of the fibers 16 will be inside in contact with the mandrel and the end of the weft 13 which has been sewed will be on the outside of the wrap. By winding the weft 13 onto the mandrel in such a manner that portions of the fibers 16 adjacent to the weft band 17 are relatively slack, a greater crimp can be induced in those portions of the fibers adjacent to the weft band 17. This is illustrated in FIG. 2 where the reference numeral 17 indicates those portions of the fibers having a greater crimp than the remaining parts of the fibers. Of course, prior to heating, the fibers 16 will all be relatively straight and in a parallel relationship. After heating, the fibers 16 will have both a curl and a crimp. FIG. 2 shows the fibers in the weft after the heat treatment step but omits the curl for purposes of clarity.

After the weft 13 has been wound onto the mandrel, the assembly is placed in an oven and heated to a temperature of 110° to 130° C. for a time period of 1 to 5 minutes to shrink the fibers 16.

After the weft 13 has been heat treated and crimped as described above, it is sewed onto the cap 11 as illustrated in FIG. 1. For purposes of illustration, the curl in the fibers 16, which is imparted to the fibers by virture of the fact that the fibers are wound onto the mandrel while being heated, is omitted for the sake of clarity. The purpose of having a greater amount of crimp in those portions of the fibers 16 adjacent to the weft band 17 is to give the weft more hiding power near the cap 11.

When it is desired to make a wig to simulate Negroid hair, 20 to 50 weight percent of the higher shrinking fiber will be in the blend. For less kinky hair, the blend will contain 5 to 20 weight percent of the fiber having the higher shrinkage.

What is claimed is:

1. The method of making a weft for use in making a wig, comprising:

a. assembling a blend of modacrylic fibers into a weft of parallel fibers, said blend being made up of (1) 5–50 weight percent of a first modacrylic fiber having a denier of 30 to 50 and a shrinkage of 5–20 percent at a temperature of 120° C. with (2) 95–50 weight percent of a second modacrylic fiber having a denier of 30 to 50 and a shrinkage of at least 5 percent less than the shrinkage of the first fiber at a temperature of 120° C. to form a fiber blend, b. sewing the weft across one end to secure the fibers together, and c. heating the weft to a temperature of 110° to 130° C. for a time period of 1 to 5 minutes to shrink the fibers.

2. The method of claim 1 wherein the blend contains 5–20 weight percent of said first fiber.

3. The method of claim 1 wherein the blend contains 20–50 weight percent of said first fiber.

4. The method of claim 1 wherein the weft is wound on a mandrel during the heating step, said weft being wound on the mandrel in such a manner that portions of the fibers adjacent to the sewed end of the weft are allowed to shrink to a greater degree than the remaining parts of the fibers.

5. The method of claim 4 wherein the tension applied to said portions during heating is less than the tension applied to said parts.

6. A wig having wefts secured to a cap, said wefts being made from a blend of 5–50 weight percent of a first modacrylic fiber having a denier of 30 to 50 and an initial shrinkage of 5–20 percent at a temperature of 120° C. and 95–50 weight percent of a second modacrylic fiber having an initial shrinkage of at least 5 percent less than the initial shrinkage of the first fiber at 120° C., said fibers having been heated sufficiently to develop said initial shrinkages, each of said wefts being secured at one end thereof to the cap.

7. The wig of claim 6 wherein the blend contains 5–20 weight percent of said first fiber.

8. The wig of claim 6 wherein the blend contains 20–50 weight percent of said first fiber.

9. The wig of claim 8 wherein those portions of the fibers adjacent to said one end are shrunk to a greater degree than the remaining parts of the fibers in such a manner that said portions have a greater crimp than said remaining parts.

* * * * *